United States Patent [19]

Plough, Jr. et al.

[11] Patent Number: 4,498,071

[45] Date of Patent: Feb. 5, 1985

[54] HIGH RESISTANCE FILM RESISTOR

[75] Inventors: Charles T. Plough, Jr.; Ralph D. Hight, both of Norfolk, Nebr.

[73] Assignee: Dale Electronics, Inc., Columbus, Nebr.

[21] Appl. No.: 431,274

[22] Filed: Sep. 30, 1982

[51] Int. Cl.[3] ..... H01C 1/012

[52] U.S. Cl. ..... 338/308; 29/620; 219/543; 219/548; 219/553; 338/314; 338/309; 338/328; 501/97; 204/192 F; 204/192 D

[58] Field of Search ..... 219/121 LM, 216, 464, 219/543, 548, 553; 338/195, 275, 279, 308, 309, 334, 322, 312, 314, 328; 427/125, 126.1; 428/446; 29/620, 621; 501/94, 96, 97; 204/192 F, 192 D, 192 EC; 261/264, 265, 266

[56] References Cited

U.S. PATENT DOCUMENTS

| | | | |
|---|---|---|---|
| 3,174,920 | 3/1965 | Post | 204/143 |
| 3,434,206 | 3/1969 | Umantsev et al. | 29/610 R |
| 3,517,436 | 6/1970 | Zandman et al. | 29/613 |
| 3,718,883 | 2/1973 | Berman et al. | 338/322 |
| 3,742,120 | 6/1973 | Keister et al. | 338/309 X |
| 3,791,863 | 2/1974 | Quirk | 338/309 X |
| 3,876,912 | 4/1975 | Sanders | 338/309 X |
| 3,895,219 | 7/1975 | Richerson et al. | 219/553 |
| 3,978,316 | 8/1976 | Rose et al. | 219/543 |
| 4,007,352 | 2/1976 | Ura | 219/543 X |
| 4,016,525 | 4/1977 | Maher et al. | 338/309 |
| 4,053,977 | 10/1977 | Simon et al. | 29/620 |
| 4,057,707 | 11/1977 | Allen | 219/543 |
| 4,064,477 | 12/1977 | Thompson | 338/308 X |
| 4,075,452 | 2/1978 | Simon | 219/121 LM |
| 4,129,848 | 12/1978 | Frank et al. | 338/308 |
| 4,172,249 | 10/1979 | Szwarc | 338/195 |
| 4,174,513 | 11/1979 | Wellard | 338/312 |
| 4,306,217 | 12/1981 | Solon | 338/275 |
| 4,318,072 | 3/1982 | Zandman | 338/314 X |
| 4,401,065 | 8/1983 | Minegishi et al. | 361/264 |

FOREIGN PATENT DOCUMENTS

| | | |
|---|---|---|
| 1085062 | 9/1980 | Canada . |
| 1525196 | 9/1978 | United Kingdom . |
| 2018036 | 10/1979 | United Kingdom . |
| 2050705 | 1/1981 | United Kingdom . |

*Primary Examiner*—Volodymyr Y. Mayewsky
*Attorney, Agent, or Firm*—Zarley, McKee, Thomte, Voorhees & Sease

[57] ABSTRACT

An electrical resistor and method of making the same is disclosed wherein a ceramic substrate is coated with a relatively rough dielectric film which is subsequently coated with a thin metal film such as nichrome.

9 Claims, 5 Drawing Figures

HIGH RESISTANCE FILM RESISTOR

BACKGROUND OF THE INVENTION

Metal film resistors are produced by depositing a thin metal film on a substrate of glass, alumina, oxidized silicon or other insulating substrate. One of the most common resistor materials is a nickel-chromium alloy (Nichrome) or nickel-chromium alloyed with one or more other elements which may be evaporated or sputtered on to a substrate. Nichrome as used here and as used hereafter in this disclosure refers to a nickel-chromium alloy or to nickel-chromium alloyed with one or more other elements. Nichrome is a very desirable thin film because of its stability and near zero TCR's over a relatively broad temperature range (−55° C. to 125° C.). The stability is excellent so long as the sheet resistance is kept below 200 ohms per square on a smooth substrate. Higher ohms per square can be evaporated but are difficult to reproduce causing low yields and exhibit poor stability under high temperature exposure or under operation with voltage applied.

Resistor films are normally stabilized by heating the exposed substrates in an oxidizing ambient to minimize future resistance changes during normal usage. For very thin films, this oxidation causes the resistance of the film to increase as the exposed surfaces of the metal film are oxidized. For thin films approaching discontinuity, this oxidation causes large uncontrollable increases in the final resistance with a corresponding large TCR shift in the positive direction. Operational life tests on these thin film parts invariably fail to meet conventional specifications for stability.

It has been observed that ceramic substrates with "rough" surfaces as measured by a Talysurf profile instrument give higher sheet resistances for a given metal film thickness than "smooth" surfaces. It would be desirable to be able to have a substrate with much rougher surface to use to manufacture in a reproducible manner a resistor with several thousand ohms per square using nichrome or other thin metal film with a stability similar to that exhibited by the thicker or lower sheet resistance films of these materials.

It is therefore the principal object of this invention to produce a high resistance film structure with higher sheet resistance, better stability, and better temperature coefficient of resistance (TCR) than sputtered thin metal film resistors made by well known techniques.

It is a further object of this invention to provide a high resistance film structure which will provide a barrier against possible diffusion of impurities from the substrate into the resistive film.

It is a further object of this invention to provide a method of making a high resistance film structure by modifying the surface of the substrate before the resistive film is applied through the depositing of a relatively rough-surfaced insulating film on the substrate before the resistive film is deposited.

These and other objects will be apparent to those skilled in the art.

A BRIEF SUMMARY OF THE INVENTION

This invention pertains to a high resistance film structure and the method of making the same that yields a thin metal film resistor with high sheet resistance, better stability and better temperature coefficient of resistance than is available in conventional thin metal film resistors. The improvements of this invention are achieved by modifying the surface of the substrate before the resistive film is applied. This is accomplished by depositing an insulative film on the substrate. This insulating film makes the surface much rougher microscopically, and thereby significantly increasing the sheet resistance of the resistive film.

Proper selection of this insulating film also provides a barrier against possible diffusion of impurities from the substrate into the resistive film. The combination of an apparently thicker film for a given sheet resistance and the barrier layer between the film and the substrate results in a resistor capable of much higher sheet resistance, and one which has better stability with near zero TCR's than can be achieved by conventional resistors. The stability referred to relates to resistance changes due to load life and long-term, high-temperature exposure as prescribed by conventional military specifications.

The structure and the process of the instant invention involves the deposition of an insulating film on the substrate before deposition of the resistor film. It has been demonstrated that an insulator such as silicon nitride or aluminum nitride can be deposited on the substrate or achieve: (1) a much rougher, more consistent surface on alumina or other ceramic substrate; and (2) a barrier layer which inhibits the diffusion of impurities from the substrate. By depositing such an insulating layer by R.F. sputtering and by carefully controlling the sputtering parameter (i.e. temperature of depositions, deposition pressure, rate, time and gas, etc.) it is possible to control the nature, and the thickness of the insulating layer.

This invention provides a resistor capable of having a sheet resistance that is several times the sheet resistance for the same deposition of film on the same type of substrate without an insulating layer. More resistor material is required for a given blank value using the silicon nitride coated ceramic, and hence it demonstrates better stability for that value. This has made possible higher sheet resistances (approximately 1500 ohms per square) with military specification stability than have ever been previously obtained using sputtered nichrome alloys. Higher sheet resistances than 1500 ohms per square may not consistently meet military specifications but are still stable, continuous films. As an example, a 5000 ohms per square will typically exhibit resistance shifts of 1.5% after 2000 hours at 150° C. and such films have TCR's below 100 ppm/°C.

DESCRIPTION OF THE PREFERRED EMBODIMENT

Figure 1:
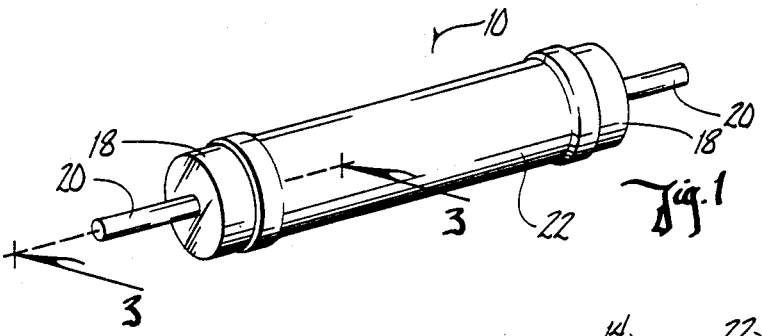
FIG. 1 is a perspective view of a resistor embodying the instant invention.
Figure 2:
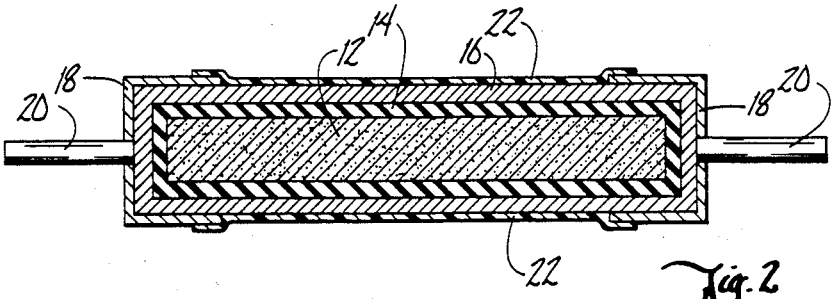
FIG. 2 is an enlarged longitudinal sectional view of the device in FIG. 1 with the end caps and leads removed.
Figure 3:
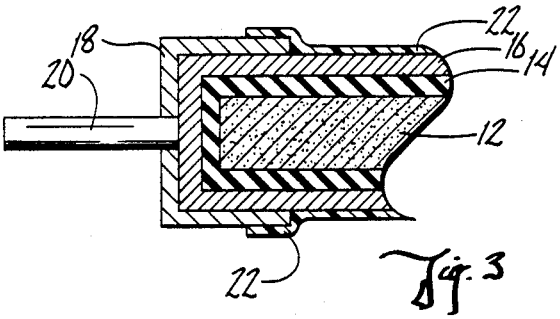
FIG. 3 is a partial sectional view taken on line 3—3 of FIG. 1 shown at an enlarged scale.

With reference to FIGS. 1–3, the resistor 10 is comprised of a cylindrical ceramic substrate 12 of conventional material. It is coated with an insulative or dietectric material 14 preferably comprised of silicon nitride. The outer surface of the dielectric layer 14 is considerably rougher than the outer surface of the substrate 12.

A resistance film 16, preferably nichrome, is coated on the entire outer surface of the dielectric material 14. Conductive metal terminal caps 18 are inserted on the ends of the composite structure of FIG. 2 with the terminal caps in intimate electrical contact with the resistance film 16. Conventional terminal leads 20 are secured to the outer ends of terminal caps 18. As shown in FIG. 3, an insulating covering, of silicone or the like 22, is then coated on the outer surface of the resistive film 16.

Figure 4:
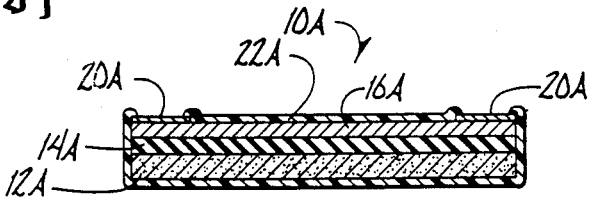
FIG. 4 is a sectional view through a modified form of resistor utilizing the instant invention.
Figure 5:
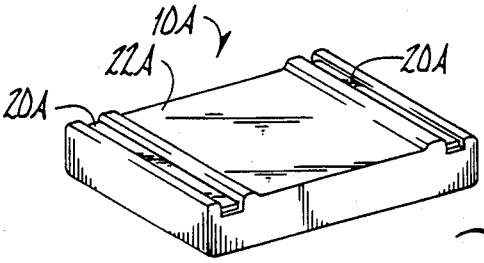
FIG. 5 is a perspective view of a coated resistor with terminal connections utilizing the structure of FIG. 4.

The resistor 10A in FIGS. 4 and 5 contain the same essential components as the resistor of FIGS. 1–3 but merely show a different type of resistor utilizing a flat substrate 12A. A dielectric material of silicon nitride 14A is deposited on the upper surface of the substrate 12A, and a resistive layer 16A of nichrome is then deposited on the upper surface of the insulative or dielectric material 14A. Conventional terminals 20A are in electrical contact with the resistive film 16A, and the entire structure, except for the terminals 20A, is coated with an insulating covering of silicone or the like 22A.

The deposition of the silicon nitride layer is accomplished by reactively R.F. sputtering 99.9999% pure silicon in a nitrogen atmosphere at 4 microns pressure. The power density is critical to the density of the $Si_3N_4$ film and was run at 1.1 to 1.3 Watts/cm$^2$ using a Plasmatherm R.F. generator system. Higher and lower pressures and lower power densities yielded results that were inferior to the above conditions. Scanning Auger Micro analysis of these films yields estimates of the dielectric film thickness of 50 to 150 Å. The coated ceramics were then annealed at 900° C. for fifteen minutes before filming with resistor material. Ceramic cores without the 900° C. annealing were less stable than annealed substrates.

Using ceramic cylinders 0.217" in length and 0.063" in diameter, the highest blank value that can be used and still meet military specifications for stability rose from around 275 ohms to over 1 kilohm. With maximum spiral factors of 3–5,000, finished values of 3–4 megohms are easily reached. The TCR's were plus or minus 25 ppm/°C. over the range of −20° C. to +85° C. Higher blank values to 5 kilohms can be used where less strict specifications apply. Blanks up to 5000 ohms have been produced with TCR's of plus or minus 100 ppm/°C. over the range of −55° to +125° C. and with a shift of less than 1.5% after 2000 hours at 150° C.

The resistor of this invention extends the range of commercial metal film resistors up to 22 megohms or greater from a previous limit of 5 megohms. It also permits the use of less expensive cores because the composition and the surface of the core is not of major importance in the fabrication of the resistor. The stability of parts using this invention improved by a factor of two or three times as compared to parts of the same blank value using standard processes.

Much higher sheet resistances are achieved by this invention, and diffusion of impurities from the core material to the resistance material is substantially eliminated.

The increase in resistance due to the change in the surface characteristics is not an obvious result of such a deposition of dielectric material. Previous attempts to increase the roughness of the ceramic surface have not resulted in any significant improvement in the stability of the resistance for a given blank value. It is not obvious that a deposition of a dielectric material will increase the resistance of the blank value while improving the stability. Thus, the change in resistance which has been obtained by the techniques described herein is not a change that would be predicted by one skilled in the art.

From the foregoing, it is seen that this invention will achieve at least its stated objectives.

We claim:

1. A high resistance film resistor comprising:

a ceramic substrate having a supporting surface;

a dielectric film coated on said supporting surface of said substrate, said dielectric film having a rough surface facing away from said substrate and being substantially rougher than said supporting surface of said substrate, said dielectric film being substantially nitride material;

a thin metal film forming a resistance element coated on said rough surface of said dielectric film, said dielectric film providing a barrier against diffusion of impurities from said substrate into said resistance element and providing electrical stability to said resistance element, whereby the sheet resistance of said resistance element is of a value a plurality of times greater than the sheet resistance obtained by placing said thin film directly on said supporting surface of said substrate.

2. The device of claim 1 wherein said metal film is comprised primarily of nichrome.

3. The device of claim 1 wherein said dielectric material is silicon nitride.

4. The device of claim 2 wherein said dielectric material is silicon nitride.

5. The device of claim 1 wherein said substrate is alumina.

6. The device of claim 1 wherein said dielectric material is aluminum nitride.

7. A resistor according to claim 1 wherein said resistance element has a sheet resistance of approximately 1500 ohms per square and exhibits resistance shifts of no more than 1.5% after 2000 hours of use at 150° C.

8. A resistor according to claim 7 wherein said resistance element has a sheet resistance of approximately 5000 ohms per square and exhibits resistance shifts of no more than 1.5% after 2000 hours of use at 150° C.

9. A resistor according to claim 8 wherein said resistance element has a temperature coefficient of resistance below 100 ppm/°C.

* * * * *